US005696339A

United States Patent [19]

Brennan

[11] Patent Number: 5,696,339

[45] Date of Patent: Dec. 9, 1997

[54] TRIANGULARLY SHAPED HANDLE

[76] Inventor: Charles R. Brennan, 2140 N. Lincoln Ave. #5202, Chicago, Ill. 60614

[21] Appl. No.: 865,941

[22] Filed: Apr. 9, 1992

[51] Int. Cl.[6] ..... G10D 13/02

[52] U.S. Cl. ..... 84/422.4

[58] Field of Search ..... 84/422.4; D17/22; 81/451, 489, 177.1; 74/551.9; 16/DIG. 12, 110 R; D8/303, DIG. 7

[56] References Cited

U.S. PATENT DOCUMENTS

| | | | |
|---|---|---|---|
| D. 295,872 | 5/1988 | Koumarianos | 84/422.4 |
| 3,608,419 | 9/1971 | Russell | 84/422.4 |
| 3,722,350 | 3/1973 | Cordes | 84/422.4 |
| 3,866,508 | 2/1975 | Huslig | 84/422.4 |
| 3,893,364 | 7/1975 | Harrison | 84/422.4 |
| 4,462,296 | 7/1984 | Heiskell | 84/422.4 |
| 4,922,575 | 5/1990 | Riemann | 16/DIG. 12 |
| 4,951,533 | 8/1990 | Hillinger | 81/177.1 |
| 4,969,231 | 11/1990 | Mader et al. | 81/177.1 |

*Primary Examiner*—Cassandra C. Spyrou
*Attorney, Agent, or Firm*—Silverman, Cass & Singer, Ltd.

[57] ABSTRACT

A drumstick having a striking portion of conventional cylindrical configuration and terminating at a striking tip, and a handle portion of generally triangular cross-sectional configuration. The triangular configuration of the handle portion can be formed by cutting away part of the drumstick, or by installing a sleeve member over the handle portion of a conventional drumstick, the sleeve member having a triangular external cross-sectional configuration.

8 Claims, 1 Drawing Sheet

28
22
24
12
30
32
26

22
32
16
28
2
18
24
30
20
2
10
12
14

4
18'
4
10'
12'

48
52
40
54
16"
6
46
50
34
44
18"
20"
10"
6
36
12"
14"

12'
18'

46
34
38
36
40
44
50
48
42

52
56

58
60

TRIANGULARLY SHAPED HANDLE

BACKGROUND OF THE INVENTION

1. Field of the Invention

This invention relates to drumsticks, and more particularly, to a drumstick having a handle portion of generally triangular cross-sectional configuration for improved gripping and feel characteristics when held by a drummer.

2. Description of the Prior Art

Prior art drumsticks generally are elongate and cylindrical in form with a circular cross-sectional configuration along the entire length. Such sticks have a handle or gripping portion terminating at a butt end and a striking portion at the end opposite the handle portion, the striking portion terminating at a striking tip.

The cylindrical handle portion of conventional drumsticks is not optimally comfortable in the hand of a drummer because it does not fit without irritation between the drummer's fingers which is a common gripping style for many drummers. Cylindrical drumsticks also become increasingly difficult to grip when the drummer's hands become moist from perspiration, or when the drummer exerts extra force against a drum or cymbal with the stick to create increased sound volume.

In order to solve the aforesaid problems encountered with conventional drumsticks, some drummers wear gloves while playing their drums to help them hold and control the sticks. It also is known to wrap tape around the handle portions of the sticks to increase control.

It is known from the prior art to flatten the handle portion of a drumstick, as taught by U.S. Pat. No. 3,893,364, in order to reduce irritation to the drummer's fingers during use. It also is known to provide a slip-on grip for a drumstick, as shown in U.S. design U.S. Pat. No. 295,872.

While the prior art patents address separately the need for improved feel and improved gripping features for a drumstick, none of the prior art has achieved a drumstick construction in which both feel and grip characteristics are optimal.

It therefore is desirable to provide a drumstick which is comfortable to hold in a drummer's hand and between his fingers, and which also provides improved gripping characteristics so as to avoid the risk of the stick slipping out of the drummer's hand during use.

SUMMARY OF THE INVENTION

The invention provides an elongate drumstick having a striking portion of generally cylindrical configuration terminating at a striking tip and a handle portion disposed along the elongate length opposite the striking portion and terminating at a butt end. The handle portion has a generally triangular cross-sectional configuration with rounded apex ends. The handle portion may either be formed by cutting away a portion of the material from which the drumstick is manufactured or by applying a sleeve over the handle end of a conventional cylindrical drumstick, the sleeve having a generally triangular external configuration. A stop plate may be applied to the butt end of the drumstick to prevent the sleeve from slipping off of the drumstick during use by a drummer.

Various objects and advantages of the invention will become apparent in accordance with the foregoing disclosure in which preferred embodiments are described in detail in the specification and illustrated in the accompanying drawing. It is contemplated that minor variations may occur to the skilled artisan without departing from the scope or sacrificing any of the advantages of the invention.

DESCRIPTION OF THE PREFERRED EMBODIMENTS

Figures 1, 2, 3, 4, 5, 6, 7, 8:
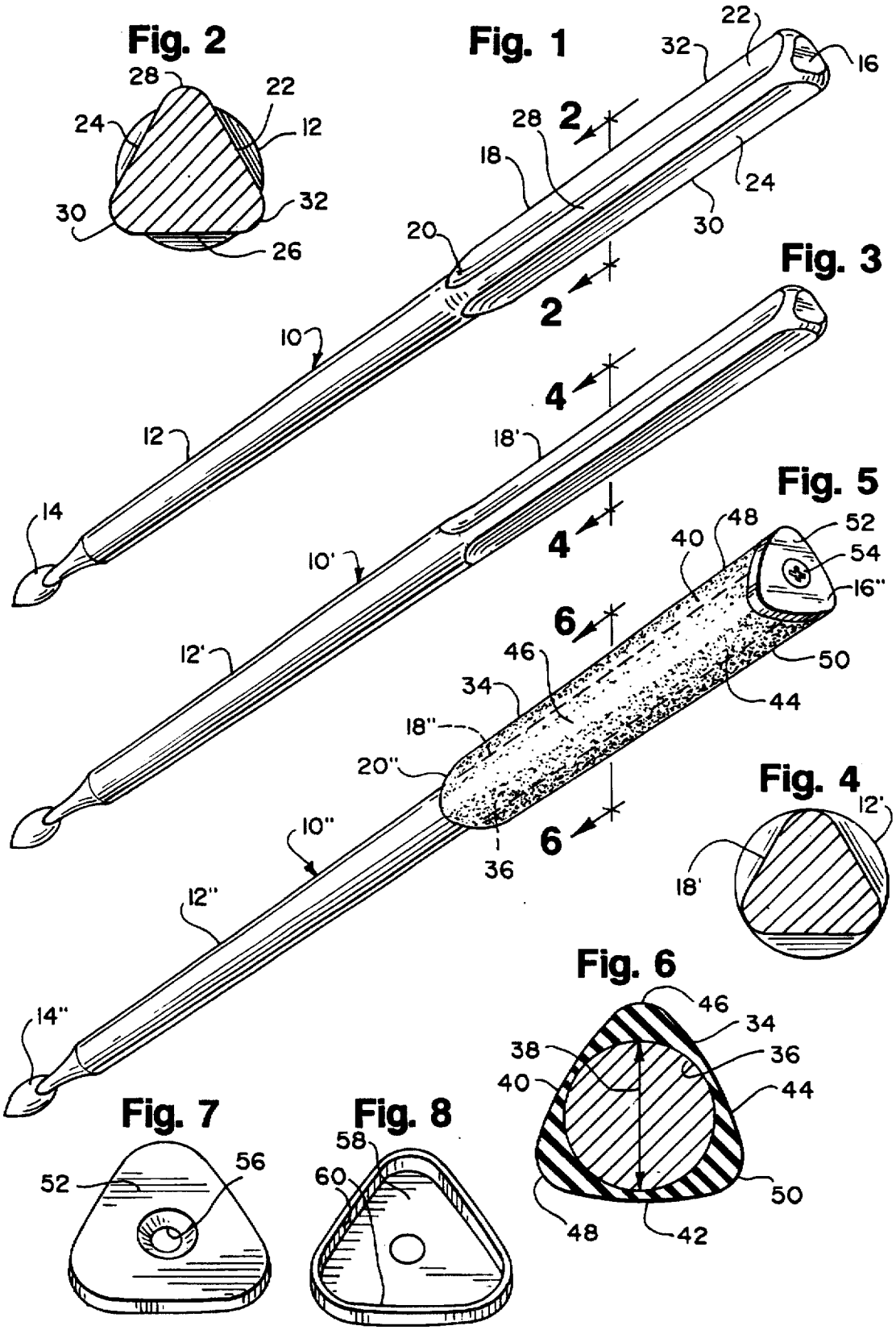
FIG. 1 is a perspective view of a drumstick constructed in accordance with the invention.
FIG. 2 is a sectional view taken along the line 2—2 of FIG. 1, in the direction indicated generally.
FIG. 3 is a perspective view of an alternate embodiment of the invention.
FIG. 4 is a sectional view taken along the line 4—4 of FIG. 3, in the direction indicated generally.
FIG. 5 is a perspective view of a still further embodiment of the invention.
FIG. 6 is a sectional view taken along the line 6—6 of FIG. 5, in the direction indicated generally.
FIG. 7 is a perspective view of a stop plate applied to the butt end of the drumstick shown in FIG. 5.
FIG. 8 is a perspective view of an alternate embodiment of such stop member.

Referring to FIGS. 1 and 2, there is shown a first embodiment of the invention which comprises an elongate drumstick 10 having a conventional cylindrical strike portion 12 which terminates at a strike tip 14. The drumstick 10 may be formed of any material, but usually is formed from hard wood, and is about sixteen inches long from the tip to the butt end 16.

Handle portion 18 of the drumstick 10 of the invention preferably extends from the butt end 16 about six inches toward the strike portion 12, terminating at area 20 of the drumstick. The precise length of the handle portion 18 can vary within the scope of the invention, but preferably is ⅜ of the length of the drumstick from the butt end toward the strike tip. The handle portion is formed by cutting away the material from which the drumstick 10 is constructed so that the cross-sectional configuration of the handle portion from end 16 to area 20 is generally triangular.

The legs 22, 24, 26 of the triangular-configured sides of handle portion 18 may be substantially equal in length, or may vary within the contemplated scope of the invention. The apex points 28, 30, 32 of the handle portion 18 are rounded for comfort fit in the hand of the drummer and so as not to cut the drummer's hand.

In the embodiment shown in FIGS. 1 and 2, the cross-sectional profile of the handle portion 18 is greater than that of the strike portion 12 so that the handle portion is thicker than the strike portion.

FIGS. 3 and 4 illustrate an alternate embodiment of a drumstick 10' which is substantially the same as drumstick 10 in all constructional details, except the cross-sectional profile of handle portion 18' is the same as that of the strike portion 12' so that the handle portion is generally the same thickness as that of the strike portion.

Although not shown in the drawing, it is to be understood that the invention contemplates that the cross-sectional profile of the handle portion of the drumstick could be formed to be less than that of the strike portion.

A still further embodiment of the invention is shown in FIGS. 5 and 6 of the drawing. In this case, a drumstick 10" is shown which is cylindrical and of generally circular cross-sectional configuration along its entire length from tip 14" to butt end 16. A sleeve 34 having cylindrical passageway 36 formed along the entire length thereof is positioned over the handle portion 18" of the drumstick 10". The diameter 38 of the passageway 36 is approximately the same as the diameter of the cylindrical drumstick 10" so that the sleeve 34 fits tightly over handle portion 18".

The external cross-sectional configuration of sleeve 34 is generally triangular with sides 40, 42, 44 being preferably, but not necessarily, of equal length, and the apexes 46, 48, 50 being rounded for comfort fit in the hand of the using drummer. The sleeve 34 may be formed of any desired material, such as rubber, wood, plastic, foam or the like, any one of which is within the contemplated scope of this invention. Also, the external cross-sectional profile of the sleeve 34 may be greater than, less than or the same as that of the strike portion 12" of the drumstick 10". Also, the length of the sleeve 34 from butt and 16" to its terminus 20" may be approximately six inches, but the precise dimension may vary within the scope of the invention.

In order to prevent the sleeve 34 from sliding off of drumstick 10" when used by a drummer, a triangular-shaped stop plate 52 may be secured to the butt end 16" by a fastener such as screw 54 which passes through beveled aperture 56 provided in plate 52 and laterally into the shank of handle portion 18." The area of the plate 52 is substantially the same as the external cross-section of sleeve 34 so that the plate covers the entire butt and 16" of drumstick 10" after sleeve 34 is installed thereon.

As an alternate to plate 52, dish-shaped stop member 58 with upstanding walls 60 can be installed on the butt end 16" in a manner similar to installation of plate 52 with the walls 60 overlying the end of sleeve 34 to more firmly secure the sleeve to drumstick 10."

The triangular external configuration of the handle portion of the drumstick of this invention is comfortable to grasp by a drummer in his hand and/or between his fingers, and improves the ability of the drummer to hold the drumstick firmly and with improved control by improved grip. The triangular shaped handle also improves the feel of the drumstick in the drummer's hand by fitting snugly yet comfortably in the hand.

While the foregoing invention has been described with reference to its preferred embodiments, various alterations and modifications may occur to those skilled in the art. All such alterations and modifications are intended to fall within the scope of the appended claims.

I claim:

1. A drumstick comprising an elongate member including a strike portion having a circular cross-section and terminating at a strike tip, and a handle portion terminating at a butt end, said handle portion being of generally triangular cross-sectional configuration and having three substantially equal length sides, the handle portion extending approximately ⅜ of the length of the drumstick from the butt end toward the strike tip.

2. A drumstick as claimed in claim 1 in which the handle portion includes a sleeve positioned over the drumstick.

3. A drumstick as claimed in claim 2 in which a stop plate is secured to the butt end of the drumstick.

4. A drumstick as claimed in claim 2 in which a dish-shaped stop member having upstanding walls is secured to the butt end of the drumstick.

5. A drumstick as claimed in claim 1 wherein the corners of the triangular cross-section handle portion extend beyond the periphery of the circular cross-section strike portion when viewed from the butt end.

6. A drumstick as claimed in claim 1 in which no portion of the triangular cross-section handle portion extends beyond the periphery of the circular cross-section strike portion when viewed from the butt end.

7. A drumstick of cylindrical configuration comprising an elongate member including a strike portion having a circular cross-section and terminating at a strike tip, and a handle portion terminating at a butt end, said handle portion being of generally triangular cross-sectional configuration and having three substantially equal length sides, the handle portion extending approximately ⅜ of the length of the drumstick from the butt end toward the strike tip, said handle portion including a sleeve with a circular passageway therethrough, said sleeve being positioned over the drumstick with the drumstick disposed within the passageway, the sleeve having a generally triangular cross-sectional external configuration.

8. A drumstick as claimed in claim 7 in which the diameter of the passageway is approximately the same as the diameter of the drumstick.

* * * * *

UNITED STATES PATENT AND TRADEMARK OFFICE

CERTIFICATE OF CORRECTION

PATENT NO. : 5,696,339
DATED : December 9, 1997
INVENTOR(S) : Charles R. Brennan It is certified that error appears in the above-indentified patent and that said Letters Patent is hereby corrected as shown below:

On the title page, item [54] and column 1, line 1, the title should read "DRUMSTICK".

Signed and Sealed this

Fourteenth Day of April, 1998

Bruce Lehman

*Attest:*

BRUCE LEHMAN

*Attesting Officer*

*Commissioner of Patents and Trademarks*